US005445078A

United States Patent [19]

Marion

[11] Patent Number: 5,445,078

[45] Date of Patent: Aug. 29, 1995

[54] APPARATUS AND METHOD FOR DISPENSING PAYLOADS

[75] Inventor: Frank A. Marion, Glendale, Ariz.

[73] Assignee: Universal Propulsion Company, Inc., Phoenix, Ariz.

[21] Appl. No.: 273,918

[22] Filed: Jul. 12, 1994

Related U.S. Application Data

[63] Continuation of Ser. No. 907,301, Jul. 1, 1992, abandoned, which is a continuation of Ser. No. 450,472, Dec. 14, 1989, abandoned.

[51] Int. Cl.[6] ..... F42B 12/36

[52] U.S. Cl. ..... 102/505; 102/334; 102/357; 102/489; 102/513; 102/704; 211/41; 221/278; 248/223.4; 248/225.1

[58] Field of Search ..... 102/334, 340, 342, 351, 102/357, 393, 489, 505, 513, 530, 531, 704; 342/12; 221/278; 211/4, 41; 248/223.4, 225.1

[56] References Cited

U.S. PATENT DOCUMENTS

| | | | |
|---|---|---|---|
| 734,684 | 7/1903 | Durham | 102/704 |
| 889,644 | 6/1908 | Szemerey | 89/14.6 |
| 2,779,281 | 1/1957 | Maurice et al. | 102/530 |
| 3,095,814 | 7/1963 | Jansen et al. | 102/505 |
| 3,626,415 | 12/1971 | Montgomery | 105/505 |
| 3,724,870 | 4/1973 | Kurokawa et al. | 102/531 |
| 3,773,351 | 11/1973 | Catanzarite | 102/531 |
| 3,797,394 | 3/1974 | Thurston et al. | 102/505 |
| 3,837,278 | 9/1974 | Gustafsson et al. | 102/505 |
| 3,958,949 | 5/1976 | Plantif et al. | 102/531 |
| 4,139,404 | 2/1979 | Goddard et al. | 149/19.2 |
| 4,307,665 | 12/1981 | Block et al. | 102/505 |
| 4,333,402 | 6/1982 | Landstrom et al. | 102/505 |
| 4,406,227 | 9/1983 | Beeker et al. | 102/505 |
| 4,719,856 | 1/1988 | Joslin | 102/505 |
| 4,805,534 | 2/1989 | Vockensperger et al. | 102/489 |
| 4,860,657 | 8/1989 | Sternicke et al. | 102/334 |

FOREIGN PATENT DOCUMENTS

| | | | |
|---|---|---|---|
| 2091855 | 8/1982 | United Kingdom | 102/505 |

OTHER PUBLICATIONS

Hawley, The Condensed Chemical Dictionary, Eighth Edition, 1971, p. 53.

*Primary Examiner*—Harold J. Tudor

*Attorney, Agent, or Firm*—Ellsworth R. Roston; Charles H. Schwartz

[57] ABSTRACT

Payload delivery of a payload compartment containing a delivery device is initiated by a suitable fusing device which ejects the delivery device from a payload section by firing a gas generator in the section base to propel the delivery device forwardly, thereby shearing retaining pins and ejecting the delivery device from the payload section. The fusing device concurrently fires a time-delayed mechanism leading to a second gas generator in the center of the delivery device. The gas generator ignites after the chaff dispenser is clear of the payload section. The ignition reaction pneumatically blows chaff (e.g. metallized dipoles) out of wrapped bundles, leaving the wrapper bonded to the delivery device and disseminating the chaff in a cloud of hot gas and air turbulently mixed in the wind shear occurring in the wake of the delivery device. The delivery device survives the dispensing and dissemination processes without losing structural integrity. Thus, no harmful debris is ejected into the chaff cloud. The generated gases disseminate the chaff and contain no component (e.g. carbon monoxide or hydrogen) combustible in air thereby precluding ignition of the metallized coating of the chaff. This maintains the chaff as electrical dipoles. The gas temperature is controlled by endothermic decomposition of companion salts in the center of the device to avoid chaff oxidation as the chaff is mixed with air during such dissemination. Chemicals mixed with the chaff react at an elevated temperature below the chaff oxidizing temperature to provide a distinctive color to the chaff without chaff oxidation.

54 Claims, 4 Drawing Sheets

APPARATUS AND METHOD FOR DISPENSING PAYLOADS

This is a continuation of application Ser. No. 07/907,301 filed Jul. 1, 1992 (now abandoned), which in turn is a continuation of application Ser. No. 07/450,472 filed Dec. 14, 1989 (now abandoned).

BACKGROUND OF THE INVENTION

1. Field of the Invention

The present invention relates generally to dispensing payloads such as chaff from rockets, mortars, bombs, gun projectiles and the like and more specifically, to an apparatus and method for dispensing and disseminating chaff or other payloads by generating pressurized gas or steam.

2. Prior Art

Chaff has been employed as a radar interdiction countermeasure ever since shredded aluminum foil called "window" was thrown from combat aircraft during World War II. Such electrically conductive material reflects multiple frequencies of the signal back to the radar receiver. The reflected signals or echoes from chaff, cloak the presence of the aircraft by cluttering the radar screen with false targets. The chaff is thus used to jam radar signals and prevent a threatening radar target from being distinguished from decoy targets created by the chaff.

Many guided missiles are equipped with radar seekers capable of detecting specific targets and locking the guidance system to home in on that target until impact of the missile with the target occurs. The target may be another missile, an airplane, a ship, a tank, or any other target that can be identified by a radar image. The potential target may counter the threat by deploying a chaff cloud around the enemy radar, thereby rendering the radar scanner ineffective. When a cloud of chaff is positioned between the radar seeker and the intended target, the target is effectively shielded behind the chaff and cannot be identified by the attacking missile.

Incoming mortar fire can be tracked by radar and the mortar location can be pinpointed for return fire. Scanning radar will reveal its own position to any passive radar receiver. Chaff-dispensing mortar rounds, deployed near the seeking radar, may prevent the radar seeker from finding the mortar location. Chaff dispensing gun projectiles may be used to jam radar seekers at intermediate ranges and chaff dispensing rockets may be used to jam radar at greater ranges. The air defense systems of major targets may be effectively neutralized by enveloping the target in chaff dispensed by bombs, rockets, gun projectiles, mortars or combinations thereof, until the target has been destroyed.

Chaff interdiction is an effective electronic countermeasure against radar, guided missiles and radar-directed fire-control systems which direct the firing of guns and mortars. However, efficient, reliable, versatile dispensing and dissemination systems for chaff payloads have heretofore presented a variety of problems. In prior art dispensers, chaff bundles are routinely ejected to the rear of a combat aircraft when its aft scanning radar detects signals of a potential threat. The chaff bundles are ejected by explosive charges which direct their force along the longitudinal axis of the bundle. Unfortunately, explosive expulsion may not adequately release the chaff from its outer wrapper. The explosive shock may break fiberglass strands from which the individual chaff dipoles are formed. The expelling gases may not adequately disseminate the tiny strands of chaff as individual electrical dipoles. The superheated combustible gases produced by the explosive compound, may not ignite when mixed with atmospheric oxygen. The aluminum or other metallic coating on one micron diameter dipoles engulfed in the fuel-air combustion process, may ignite in the presence of atmospheric oxygen and nitrogen to form aluminum oxide or aluminum nitride, both of which, being electrically nonconductive, would preclude proper functioning of the chaff dipoles. The axial explosive loading may crush the bundle of fibers into a matted "bird's nest" which would, of course, prevent the proper dissemination and distribution of the dipoles to operate as intended.

The nature of such problems encountered in the prior art is better understood by acquaintance with the nature of the chaff material. A chaff dipole usually consists of an aluminum-coated fiber of boro-silicate glass having a specific length corresponding to the wavelength of the radio frequency of the enemy's radar or other detection device. Dipoles of this composite material are produced in diameters of one micron or less. A single dipole of chaff is difficult to see by the unaided eye. A chaff bundle having a cross-section of one square inch contains approximately five hundred thousand such dipoles. If these dipoles are, for example, one inch in length, the volume of one cubic inch of such dipoles weighs about 0.0375 pounds. Thirteen million such dipoles would weigh less than one pound.

The surface area of a pound of dipoles is on the order of 115 square feet. Accordingly, a dipole has very little mass and very high surface area. These characteristics of chaff dipoles allow the cloud of dipoles to float or to remain suspended in air for long periods of time and they are made this way for that very purpose. However, their design prevents them from being accelerated by explosive forces because they have no significant mass to store kinetic energy and their large specific surface area generates a great deal of aerodynamic drag so that any stored kinetic energy is quickly dissipated before the dipoles can travel for any significant distance through the atmosphere.

Still another problem associated with dissemination of chaff is electromagnetic attraction between the dipoles. The fiberglass strand is an electrical insulator and it is coated with a microscopic film of aluminum. When an insulator is coated with a conductor, it is capable of accumulating and holding a capacitive charge of static electricity. The electrically-charged fiber becomes an electromagnet with positive and negative polarities. Hence, it is called a dipole. Due to the low mass and high specific surface area of this material, the magnetic attraction between dipoles of opposite charge represents a force of significant magnitude between the chaff dipoles which must be overcome during dispensing and dissemination.

Accordingly, there has been a long felt need for a chaff or other payload dispensing and disseminating system which reliably releases the chaff from its wrapper; which will not break the fiberglass strands into multiple fragments; which will reliably disseminate the tiny strands of individual dipoles; which will permit the complete combustion of the gases used for disseminating the dipoles; which will not result in the ignition of the aluminum coating on the surface of the dipoles; which will not crush the bundle of fibers into a matted bird's nest; and which will assure the uniform, broad distribution of the chaff dipoles quickly and efficiently overcome magnetic attraction between the oppositely charged poles of the individual dipoles of chaff.

SUMMARY OF THE INVENTION

The present invention solves the aforementioned long felt need by providing a chaff or other payload dispensing and dissemination apparatus and method which expel and forcibly separate the dipoles of chaff. This system utilizes a flow of pressurized gases specifically generated for that purpose while obviating the problems created by the explosive reaction products of the prior art. More specifically, in the present invention, the gases that are produced are fully oxidized in a combustion chamber to prevent their secondary combustion in the atmosphere. The combustion gases are cooled by endothermic decomposition of companion salts to reduce their composite temperature below the ignition temperature of aluminum. Conventional single-based and double-based combustible materials, composite solid combustible materials and explosive compounds, are fully oxidized by the addition of ammonium nitrate as a pyrotechnic powder mixture. The combustion gases are then cooled by transferring their excess heat to companion salts which endothermically decompose to release water vapor. By avoiding the generation of combustible gases and by cooling the generated gases below the ignition temperature of aluminum, the threat of chemical destruction of the chaff is obviated in the present invention.

In a preferred embodiment of the present invention, which is designed for the dispensing and dissemination of chaff, the chaff is bundled in an outer wrapper which may be made of plastic, film, paper or metal foil. The generated gases are forced to flow through the bundle of chaff to disseminate and disburse it into the atmosphere. The wrapper material on that portion of the bundle facing the gas generator is provided with a plurality of slits. Additional slits are made on the outboard side of the chaff bundle automatically when the chaff payload is ejected from the payload canister as will be described hereinafter. Thus, when the generated gases flow through the bundle of chaff, the dipoles are sheared out into the gas flow and transported in the air fluent gas volume to produce a cloud of the desired size and volume as the generated gases mix benignly with air in the wind shear of the transporting device.

The delivery system of the present invention provides a cylindrical payload compartment containing the structural delivery device which houses the chaff bundles or such alternative payloads as flechettes, pellets, leaflets, or other payloads. Payload delivery is initiated by a suitable fusing device which ejects the structural delivery device from the cylindrical payload compartment by firing a gas generator in the base of the compartment to propel the device forward. The fusing device can currently fire as a time-delayed mechanism leading to a second gas-generating device in the center of the structural delivery device which ignites after the chaff dispenser is clear of the cylindrical payload compartment. This second gas-generating device pneumatically blows the chaff out of the wrapped bundles, leaving the outer wrapper bonded to the structural framework and disseminating the chaff dipoles in a cloud of hot gas and air mixed with the generated gases by turbulently mixing in the wind shear occuring in the wake of the delivery device. The structural delivery device of the present invention is designed to survive the dispensing and dissemination process without loss of structural integrity thereby precluding any potentially harmful debris from also ejecting into the chaff cloud.

OBJECTS OF THE INVENTION

It is therefore a principal object of the present invention to provide a chaff dispenser which substantially reduces or entirely overcomes the noted deficiencies of the prior art.

It is an additional object of the present invention to provide an apparatus and method for dispensing and disseminating chaff for interdiction of radar by utilizing explosive expulsion which reliably releases the chaff from its wrapper without damaging the individual chaff strands, without inadvertently igniting the aluminum coating on the chaff strands, while simultaneously assuring a wide dispersion of the chaff to avoid matting or crushing the bundle of fibers of chaff and overcoming the force of magnetic attraction between poles of opposite charge on the chaff.

It is still an additional object of the present invention to provide an apparatus for dispersing a payload from rockets, mortars, bombs, gun projectiles and other such vehicles by utilizing a novel, mechanical structure in combination with ignition of a combustible gas mixture for forcibly blowing the payload radially away from the vehicle by the gases produced thereby.

It is still an additional object of the present invention to provide an apparatus for dispensing and scattering chaff particles by means of gas flow produced by a selectively induced chemical reaction.

It is still an additional object of the present invention to provide an apparatus and method for producing a chemical reaction for generating completely oxidized gases or steam which may be used to dispense a payload from a vehicle in flight such as for the dispensing and scattering of chaff particles.

It is still a further object of the present invention to provide an apparatus and method for radially dispersing and scattering chaff from a vehicle in flight without also scattering any debris that might otherwise interfere with the flight behavior of following vehicles.

It is still a further object of the present invention to provide a payload dispenser which permits simultaneous generation of an identifying smoke cloud produced by evaporation or sublimation of chemical dyes in a steam generator-controlled environment which precludes destruction of the dye molecules.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment of the invention when taken in conjunction with the following drawings in which.

DETAILED DESCRIPTION OF A PREFERRED EMBODIMENT

Figures 1, 2:
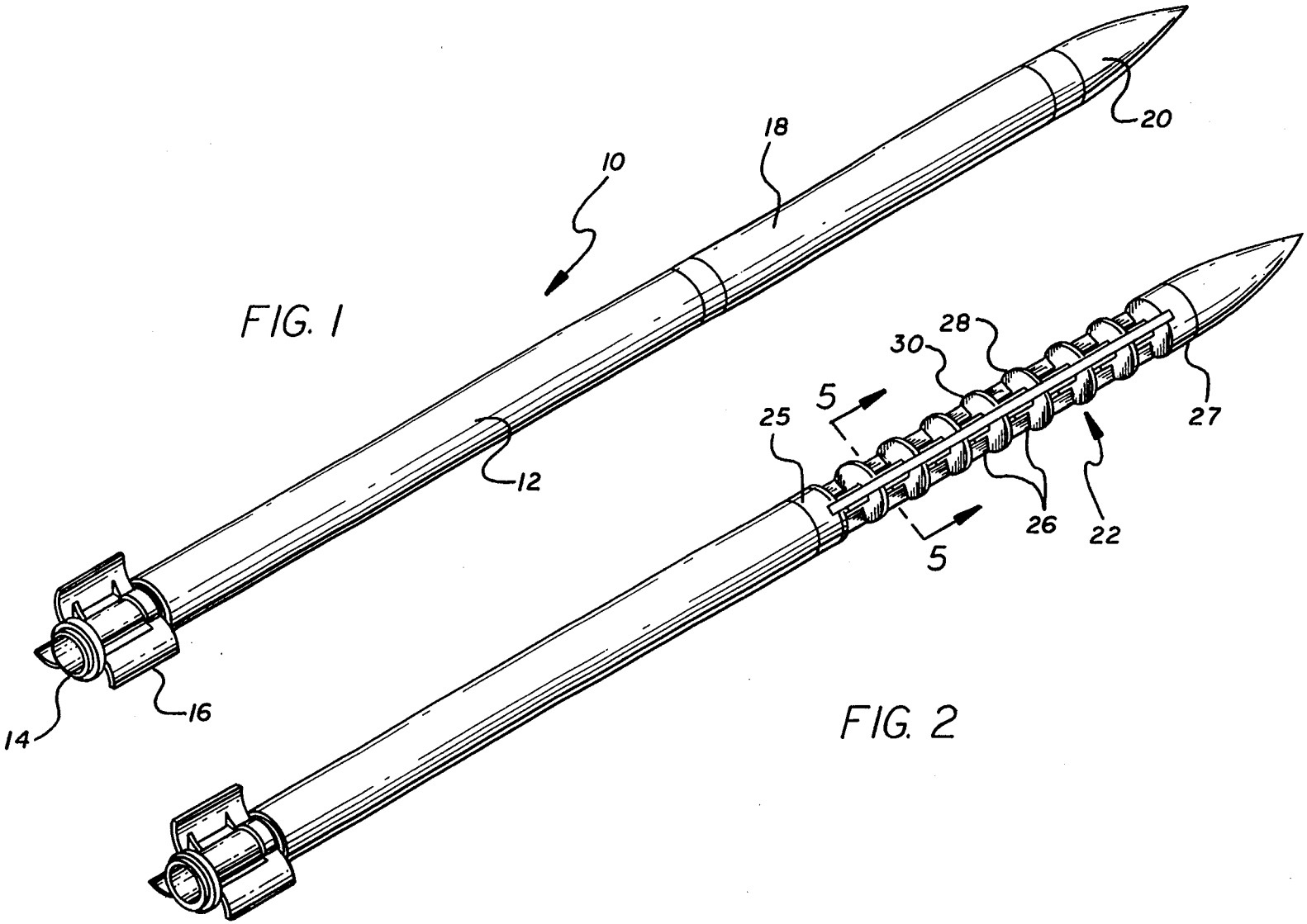
FIG. 1 is an isometric drawing of a delivery vehicle for use with the present invention.
FIG. 2 is a view similar to that of FIG. 1, but showing the payload compartment of the vehicle cut away to reveal the dispenser structure of the present invention.

FIG. 1 illustrates an exemplary delivery vehicle 10 with which the present invention may be used. Delivery vehicle 10 is of a rocket configuration. However, it will be understood that the present invention is not limited to use with rockets, but may also be advantageously employed in mortars, bombs, gun projectiles and the like. The rocket-style delivery vehicle 10 shown in FIG. 1 comprises a booster rocket 12 having a thrust generating nozzle 14 and a plurality of aerodynamically stabilizing fins 16. A payload compartment 18 is provided forward of the booster rocket 12 and terminating in a nose cone 20 designed to minimize air resistance in a conventional manner.

As seen in FIG. 2, the payload compartment 18 of delivery vehicle 10 contains the payload dispenser structure 22 of the present invention. The aft portion of the dispenser structure is provided with a rear base plate 25 and the forward portion thereof is provided with a forward base plate 27 which is disposed immediately aft of the nose cone 20. Rear base plate 25 is disposed adjacent a fusing device contained within the booster rocket. The fusing device (not shown) serves a dual purpose of explosively releasing the dispenser structure 22 from the delivery vehicle 10 and also igniting the gas generating portion of the present invention. The dispenser structure 22 provides a plurality of individual payload sections 26 disposed between the rear base plate 25 and the forward base plate 27. The structure of sections 26 will be disclosed hereinafter in more detail in conjunction with FIGS. 3–5.

The dispenser structure 22 is designed to telescope into the cylindrical payload compartment 18 of the delivery vehicle 10 and to be ejected from the payload compartment by high pressure gases acting upon the rear base plate 25 which serves as a piston during the ejection process. The high pressure gases are generated by a solid propellant charge which is ignited pyrotechnically upon receipt of a signal from the fuse system in the delivery vehicle. Thus, during the ejection process, dispenser structure 22 is explosively forced to travel forward through the cylindrical tube forming the outer skin of payload compartment 18.

Figure 3:
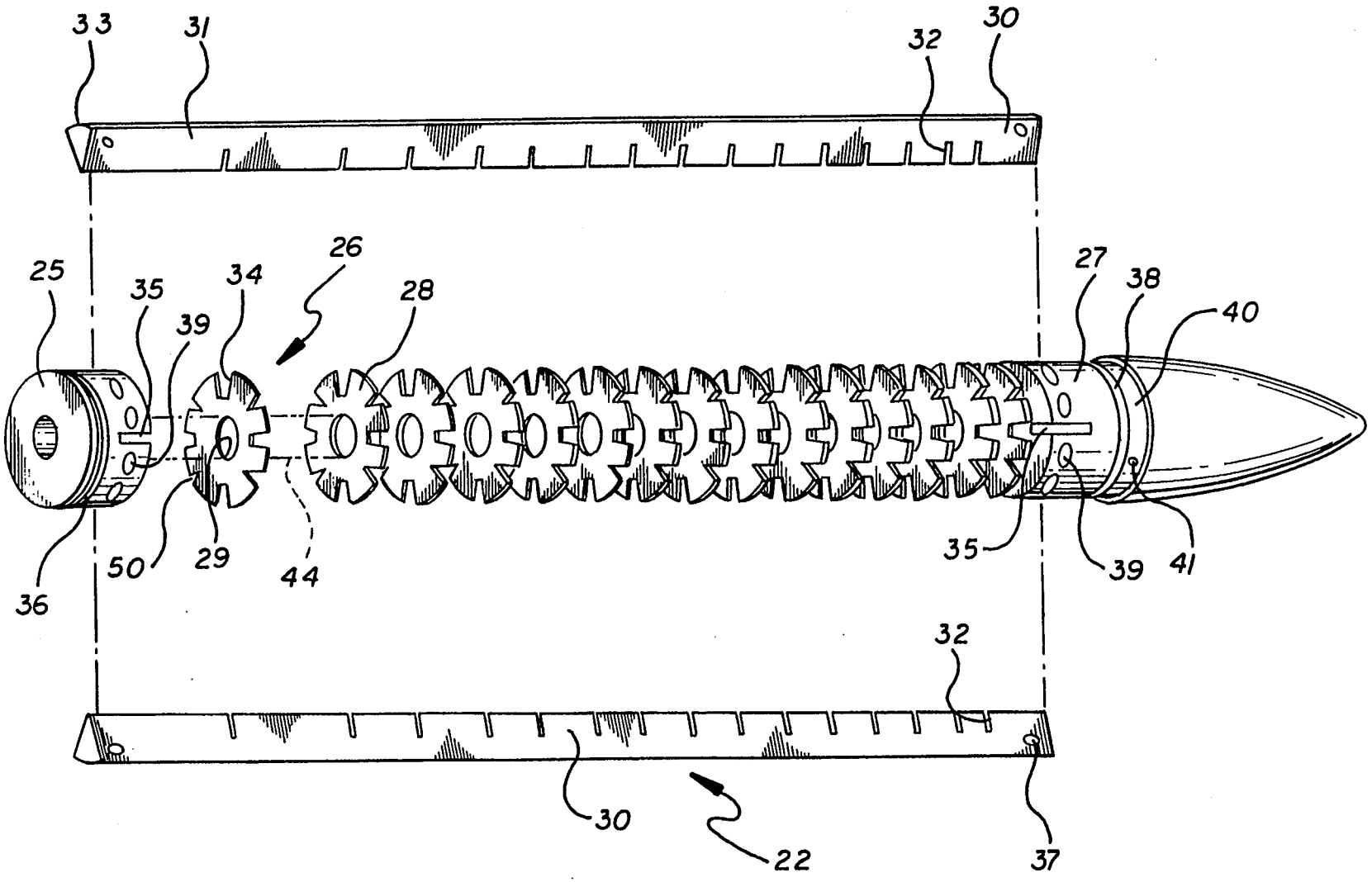
FIG. 3 is an exploded view of the payload dispenser portion of the present invention.

A preferred embodiment of the structure of the dispenser 22 of the present invention may be understood by referring to FIG. 3. Dispenser structure 22 comprises a plurality of disks 28 and a plurality of elongated columns 30. Each pair of adjacent disks defines the axial surfaces of an individual payload section 26. As seen in FIG. 3, the disks 28, in the preferred embodiment shown therein, are all of a generally circular configuration and are all aligned with the axis of the dispenser structure which is, in turn, aligned with axis of the delivery vehicle to form a generally cylindrical array. In addition, each such disk is substantially perpendicular to such axis and thus is substantially parallel to every other disk. In addition, disks 28 are each provided with a centrally disposed circular cutout 29 which, as will be described hereinafter in more detail, accommodates the gas generator tubes of the invention.

Disks 28 are preferably made of a thin metallic material which may be readily cut or stamped into the desired configuration to provide the central circular cutout 29, as well as a plurality of notches around the periphery thereof. More specifically, there are two types of notches, including column retaining notches 34 and cutting notches 50. The column retaining notches 34 of the respective disks are longitudinally aligned with one another, so that each such set of aligned columned retaining notches is disposed for receiving one of a plurality of columns 30. Each column has a roughly triangular cross-section, thus forming an elongated wedge-shaped member having a pair of angled interior surfaces 31 and a curved or arched exterior surface 33. In addition, the columns 30 are provided with a plurality of grooves 32 spaced along the column at the same intervals as the spacing between the disks 28. The dimensions and shape of the columns 30 and the depth and position of the grooves 32 therein enable structural mating between the columns and the disks. The columns support the disks in spaced, axial relation and the disks receive the columns so that the outer arched or radial surface 33 thereof substantially conforms to the peripheral edge shape of the circular disks. The structural combination of the disks 28 and columns 30 are secured to the rear base plate 25 and forward base plate 27. Base plates 25 and 27 are provided with a plurality of receiving slots 35 to which the terminal ends of the columns may be fastened through fastening holes 37 made accessible by a pair of angled recesses 39 on each side of each such slot 35.

Dispenser structure 22 is sealed with a pair of O-rings, namely, O-ring 36 at rear base plate 25 and O-ring 38 at forward base plate 27. In addition, a transition region 40 between the forward base plate 27 and the nose cone 20 is provided with a plurality of roll pins 41 connecting the forward end of the dispenser structure with the cylinder forming the outside surface of payload compartment 18. The forcible pneumatic ejection of the dispenser structure 22 in the manner previously described shears the roll pins 41 and releases the dispenser from the payload compartment.

Figure 4:
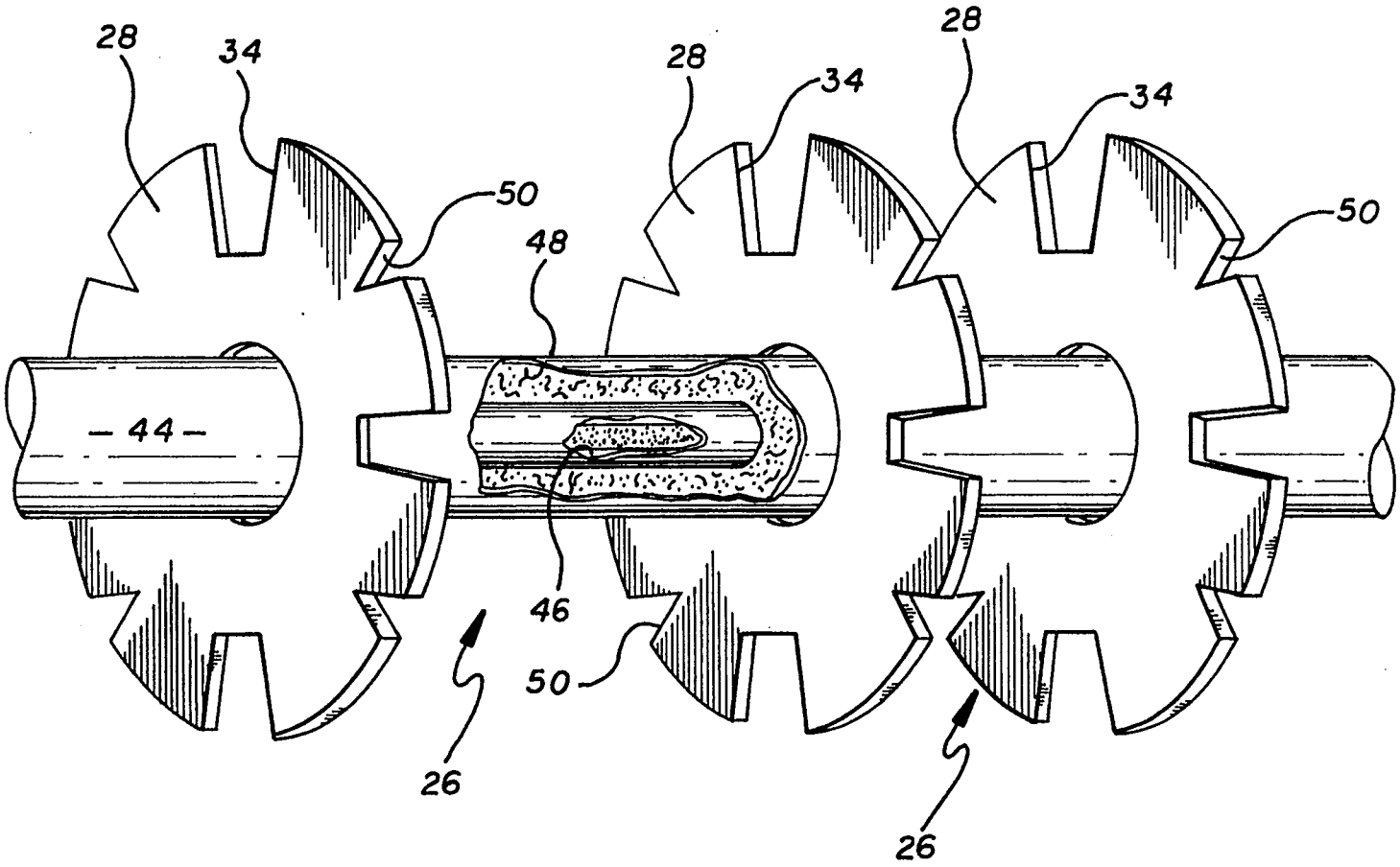
FIG. 4 is an enlarged view of payload compartment of the present invention with the payload removed to show the tubular gas generating structure thereof.

After the fuse in the delivery vehicle initiates combustion of a gas generator propellant to separate the dispenser from the vehicle, it also ignites a pyrotechnic column 44 shown in FIG. 4. Column 44 is designed to ignite a central burster gas generator which comprises an elongated inner tube structure 46 contained within a coaxial outer tube 48. This coaxial inner and outer tube structure of gas generator 44 extends through each of the central circular cutouts 29 of the plurality of disks 28 from the rear base plate 25 to the forward base plate 27. Tubes 46 and 48 may be made from a readily burst material such as thin-walled polyethylenes. Inner tube 46 contains combustible material 45 and oxidizer 47 such as a combination of nitrocellulose and ammonium nitrate. When these materials react, inner tube 46 fractures and gases flow rapidly into outer tube 48. Outer tube 48 contains a hydrate 49, such as borax or boric acid. Heat from the expanding gases in the inner tube 46 causes water in the compound contained within the outer tube 48 to become released in an endothermic reaction. The water lowers the temperature of the expanding gases. This combination of expanding gases, cooled by water, produces large radial directed forces against the payload within the individual payloads sections 26 to forcefully expel the payload out of the dispenser structure 22. The payload is effectively sheared out by the gas flow and transported into the air fluent gas volume as the generated gas is mixed benignly with the air in the wind shear adjacent the dispenser structure.

When the present invention is used in conjunction with chaff, the effect of the generated gases is to expel and to forcibly separate the dipoles 53 of chaff. It is in this application that the unique gas generated portion of the present invention is particularly advantageous. More specifically, aluminum ignites in air at 650 degrees centigrade. Due to the high thermal conductivity of aluminum and the low thermal conductivity of glass, the induction time to heat a microscopic thickness of aluminum above its ignition temperature is extremely short, particularly in the presence of hydrogen combusting to water and carbon monoxide combusting to carbon dioxide. Aluminum is capable of removing oxygen from either of these combustion products to support its own combustion and heated aluminum is capable of reacting with either nitrogen or oxygen readily available in the atmosphere. If aluminum combustion strips oxygen from water, then the hydrogen reacts with atmospheric oxygen. Similarly, carbon dioxide reduced to carbon monoxide will also react with atmospheric oxygen to sustain the fuel air combustion process in a regenative mode. If the aluminum coating is removed from the glass fiber, the individual chaff elements are no longer electrical dipoles. If the surface of the glass fiber is coated with aluminum oxide or aluminum nitride, the chaff elements cease to perform as an electrically reflective dipole. The present invention produces gases that are fully oxidized in the combustion chamber to prevent their secondary combustion in the atmosphere. Furthermore, the combustion gases are cooled by endothermic decomposition of companion salts to reduce their composite temperature below the ignition temperature of aluminum. Damage to the aluminum coating is precluded by avoiding the generation of combustible gases and by cooling the generated gases below the ignition temperature of aluminum. The threat of chemical destruction is thus removed in the chaff dissemination process of the present invention.

Conventional solid propellants and explosives do not fully oxidize their combustion products. Nitrocellulose, nitrated to 12.6% nitrogen, has an empirical formula of $C_{600}\ H_{755}\ O_{990}\ N_{245}$, and the combustion products would be $390\ CO_2+210\ CO+377.5\ H_2+122.5\ N_2$. In order to complete the combustion of CO to $CO_2$, and $H_2$ to $H_2O$, 585.5 oxygen atoms must be added to the formulation. Ammonium nitrate is one source of oxygen, as the decomposition of $NH_4NO_3$ produces $2H_2O+\frac{1}{2}+N_2$. Thus an empirical formula of nitrocellulose+585.5 moles of ammonium nitrate would produce reaction products of fully oxidized carbon dioxide and water, plus the essentially neutral gas, nitrogen. When nitroglycerin, $C_3H_5O_9N_3$, is added to nitrocellulose in the manufacture of "double-base" propellant, it functions primarily as a plasticizing agent. Although it does contain sufficient oxygen to completely oxidize its hydrocarbon content, the oxygen surplus is only $\frac{1}{4}$ mole of $O_2$ per mole of nitroglycerin, and the saturation limit of nitrocellulose would be exceeded long before enough oxygen would be available to fully oxidize the hydrocarbon content of nitrocellulose. Nitric esters, such as HMX and RDX, are also oxygen deficient. HMX, $C_4H_8O_8N_8$, oxidizes the carbon to $CO_2$, but needs $2O_2$ to oxidize the hydrogen to $4H_2O$.

The optimum design of all solid propellants and explosives involves trade-off considerations between energy yield and the average molecular weight of their reaction gases, and this optimum occurs below the level of total oxidation. Therefore, in order to produce combustion gases that are fully oxidized, more oxygen must be added to such reactants.

Fully oxidizing the gases raises their temperature and the gas temperature must be lowered by transferring heat to other mass, or by diluting the gas with a cooler gas source. Both of these mechanisms are employed when endothermic salts are decomposed, by absorption of heat, to release cooler gases. The cooler gases may, or may not, be fully oxidized. A hydrate, such as borax, or boric acid, will release water as a decomposition product; whereas, oxalic acid, $(COOH)_2$, decomposes to $2CO_2+H_2$, and requires $\frac{1}{2}\ O_2$ to oxidize the hydrogen.

The unique tubular generator structure of the present invention is also readily adapted to alternate chemistries for complete oxidation and endothermic cooling. By way of further example, the tubular generator structure disclosed herein may instead be implemented as a steam generator.

The steam generator uses a pyrotechnic powder mixture as a heat source, and a hydrated salt coolant to absorb heat and generate steam. The pyrotechnic mixture uses a metal fuel, such as aluminum powder, and an oxygen source, such as cupric oxide (CuO), lead peroxide ($PbO_2$), or manganese dioxide ($MnO_2$), in stoichiometric proportions forming aluminum oxide ($Al_2O_3$). The aluminum oxide and metal vapor condenses out upon the hydrated salt, such as the trihydrate of alumina ($Al_8O_3.3H_2O$), or sodium tetraborate decahydrate ($Na\beta_4O_7.10H_2O$). Heat transferred to the hydrate decomposes the salt, releases molecular water, and converts the molecular water to live steam.

The pyrotechnic reaction may produce combustion temperatures exceeding 7500 degrees F., such as 13.1% Al+86.9% $PbO_2$, and the coolant absorbs that heat until it reaches the decomposition temperature, which is 300 degrees C., 572 degrees F., for hydrated alumina; and 200 degrees C., 392 degrees F., for borax. Borax is the preferred coolant and water source because it releases almost twice as much steam as hydrated alumina, per unit of weight and volume; and, the steam is up to 180 degrees cooler.

Aluminum powder ignites in air at 650 degrees C., 1202 degrees F. Therefore, if the aluminum-coated chaff 53 is disseminated by steam at temperatures below 1000 degrees F. and, preferably in the order of 400 to 600 degrees C., the aluminum should not ignite because the oxygen atom is bound to hydrogen by −57.8 Kcals/mole heat of formation.

Aluminum reacts with both nitrogen and oxygen, found in air, and with combustion products containing chlorine, fluorine, and sulfur, or their acid forms. Steam is not only a chemically benign gas, it is also a flame suppressant. It also has a low infrared signature, which transmits poorly via the moisture laden atmosphere.

Selecting chaff bundles of different dipole lengths, in specific combinations, produces specific target images. A chaff payload producing a certain target image may be identified by a color code on the payload container. The same color smoke generated in the dispensing cloud permits visual location of the chaff cloud and confirmation of the target identity by the pilot. Although the pilot could locate and identify the chaff cloud by scanning his on-board radar, this would interfere with his visual surveillance of the combat zone. A smoke cloud may also be used to guide other aircraft through the chaff cloud.

A multiplicity of target images, each simulated by specific chaff payloads, require a multiplicity of color codes to identify the simulated targets, and an equal number of smoke generators 51 to generate the smoke color identifying each target image. The smoke may be generated as a by-product of pyrotechnic reactions, or by controlled evaporation, or sublimation, of dyes.

A pyrotechnic reaction between metal zinc and an oxidizer, such as potassium perchlorate, will produce white smoke in the form of zinc oxide and potassium chloride. Yellow smoke can be produced by reducing lead hydroxide to lead oxide. Green smoke can be generated by reducing manganese hydroxide to manganese oxide.

Various colors can be produced by pyrotechnic reactions, but these are crystalline particles on the order of one micron in diameter. Particles in this size range contain 100,000 to 1,000,000 atoms; whereas, a vaporized dye is comprised of molecules made up of 21 to 41 atoms linked together. A smoke cloud of vaporized dye is 3 to 5 orders of magnitude more effective than a smoke cloud of pyrotechnic solid crystalline residue.

The problems associated with dispensing colored smokes are describe by Ellern, in "MODERN PYROTECHNICS", Chemical Publishing Co., Inc. 1961, at pages 110 and 111. Ellern states that "The mixture of a combustible and carbonizable organic material with pyrochemical components can lead to as much as 65% destruction of the dye. In addition, the emitted smoke itself may ignite, and thus convert the brilliant display of billowing, brightly colored cloud into a miserable gray plume."

Ellern goes on to say that combustion can be prevented by cooling the gases and aerosol, but he does not explain how this is done.

The steam generating feature of the present invention provides the capability of first cooling the fully oxidized combustion product to temperatures below the destructive dissociation temperature of the dye chemical. This feature then avoids combustion of the dye by chemical reaction with the disseminating gases, and finally cools the disseminating gases and aerosol below the ignition temperature of any constituent gas mixed with atmospheric oxygen. Thus thermal and thermochemical destruction of the dye is avoided or prevented by controlling the gas temperature and the chemical environment of the dye as it is vaporized, or sublimed, and disseminated in the aerosol cloud.

Most of the dye chemicals mentioned by Ellern, and many other similar chemicals, are found in "Lange's Handbook of Chemistry", Eleventh Edition. These are, predominantly, the anthraquinone derivatives producing yellow, red, orange and blue as basic colors. Yellow and red can also be mixed to produce orange and the shade of orange can be altered by adding either more red or yellow. Yellow and blue can be mixed to produce green. Blue and red can be mixed to produce violet. Thus the primary colors red, yellow and blue; and, the secondary colors orange, green and violet, may all be produced by vaporizing dye materials in a controlled thermal and thermochemical environment. White smoke provides a total of seven color codes available to identify chaff clouds.

Obviously, the colored smokes can be generated for other purposes such as signals, dye markers, spotting charges, etc., and the modes of delivery include bomblets, grenades, mortars, rockets, shells and the like.

The colored smoke can be generated instantaneously by explosion, or by pyrotechnic reaction; or, the smoke can be generated over protracted time periods by using solid or liquid propellants to generate the stimulus gases. Smoke generators using solid propellants may be designed as self-propelled signal rockets.

Anthraquinone boils at about 380 degrees Centigrade. Because it is more stable than its derivatives, the derivatives should boil, or sublime, at a temperature below 400 degrees C. hydrogen ignites in air at 580 C., and carbon monoxide at 650 C. Therefore, the disseminating gases and aerosol mixture should be cooled below 580 C., to prevent ignition of the dye compounds, and the boiling, or sublimation, of the dye materials should occur at temperatures as low as 400 degrees Centigrade. If the gas-aerosol temperature is designed to reach equilibrium at 400 to 500 degrees C., or about 750 to 1000 degrees Fahrenheit, the dye should be safely dispensed as an aerosol, without risk of ignition in air.

Thus the steam generating feature of the present invention provides the additional capability to produce and disseminate colored smoke by safe and efficient evaporation or sublimation of dyes, without destruction of the dye molecule, and without risk of burning the aerosol in air.

In either the gas generator or steam generator embodiments, the chemical reactions are sequential. First, there is the ignition of the propellant; then, the oxidizer; followed by the decomposition of the coolant. The propellant ingredients react to release heat and produce gases, including some gas species that are subject to further oxidation. The propellant gases transfer heat to the oxidizer, decomposing it and providing oxygen to react with the combustible propellant gases. This mixture of gases provides time heat needed to decompose the coolant compound, including oxygen, if needed, to complete the oxidation of the coolant gases. The entire sequence of reactions may occur within a millisecond of elapsed time, and appear to be a single event, but the reactions do occur sequentially to produce the fully oxidized and cooled mixture of gases formulated to dispense and disseminate chaff and other potentially flammable payloads without damaging those payloads.

Figure 5:
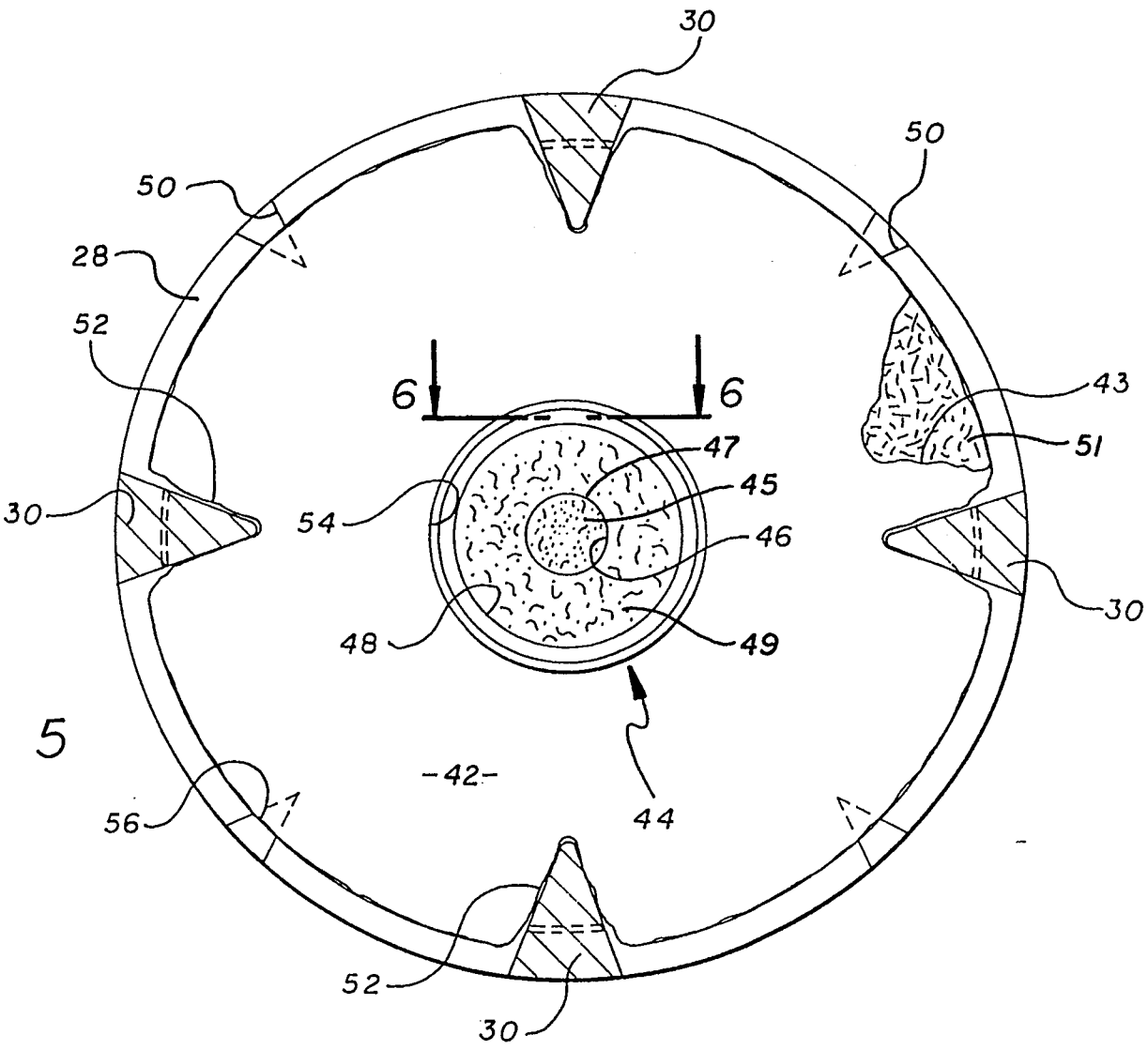
FIG. 5 is a cross-sectional enlarged view of an individual compartment of the payload dispenser of the present invention and is taken substantially on lines 5—5 of FIG. 2.
Figure 6:
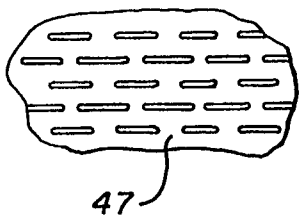
FIG. 6 is a sectional view taken substantially on the lines 6—6 of FIG. 5 and shows additional details of the payload dispenser.

Reference will now be made to FIG. 5 which illustrates the pre-dispensed configuration of a payload section of the present invention when it is used for its particularly advantageous function of dispensing chaff. For convenience in shipping and handling and also to immobilize the chaff within the payload sections 26, the chaff is bundled in an outer wrapper which may be made of plastic film, paper, or metal foil. The chaff bundling wrapper is cut circumferentially as at 57 in FIG. 6 on the surface 54 facing the gas generator 44 to allow venting of the gases directly into the chaff. The wrapper is also slit longitudinally along those exterior surface portions 56 which overlap the cutting notches 50 of the disks 28. Such slits are produced as the dispensing structure moves past cutting edges (not shown) mounted on the forward end of the payload compartment during the ejection of the dispenser structure therefrom. Accordingly, when the generated gases burst the wall of the central burster tube 48 to vent the gases through the payload, the gas flows through the bundle of chaff.

As seen further in FIG. 5, the chaff bundle 42 is of a generally cylindrical shape, but having a hole through the center to accommodate the gas generator 44 which passes through the disk and the chaff bundle. The periphery of the chaff bundle is also interrupted adjacent the plurality of columns 30, the wedged portions of which extend toward the center of the disk and the chaff bundle creating depressions in the outer periphery of the chaff bundle. In a preferred embodiment of the present invention, the chaff bundle wrapper 43 is glued or otherwise affixed at 52 to the side surfaces 31 of each of the columns 30. Accordingly, as the gas flows through the bundle of chaff, the bundling wrapper material remains bonded to the walls of the dispenser structure 22 formed by the triangular columns 30 that support the separated disks 28.

The dispenser structure is designed to resist the flow of high pressure gases from the gas generator 44, the triangular column 30 having a thin-edge facing the gas generator thus presenting a low profile to the gas pressure and reducing the beam loading perpendicular to the column. Disks 28 also present a low profile to the flow of high pressure gas and the pressure is equalized on both sides of the disk. This design enables the structural elements and the integrated structure of the dispenser structure to survive the high pressure gas flow intact without allowing any debris to be ejected with the chaff dipoles. This is a particularly advantageous feature of the invention in "follow the leader" tactics where a lead airplane sequentially fires chaff rockets toward the mission target to create radar barriers shielding its own approach and all other aircraft follow the lead aircraft through the chaff clouds. The presence of "indigestible" debris, if sucked into the engines of following aircraft, may be more effective than enemy fire in downing such aircraft.

It will now be understood that what has been disclosed herein comprises a method and apparatus for dispensing and disseminating chaff or other payloads from rocket propelled missiles, mortar or gun propelled projectiles and air dropped bombs. The apparatus comprises a cylindrically-shaped payload compartment providing a structural delivery device containing the chaff or alternate payload such as flechettes, pellets, leaflets or other such payloads as may be conveniently disseminated radially by means of generating high pressure gases. Payload delivery is initiated by a suitable fusing device which ejects the structural delivery device from a cylindrical payload compartment by firing a gas generator in the base of the compartment to propel the device forward, shearing retaining pins and pushing the delivery device out of the payload compartment with hot pressurized gases generated from solid propellants or other explosive materials. The fusing device concurrently fires a time-delayed mechanism leading to a second gas generating device in the center of the structural delivery device which ignites after the chaff dispenser is clear of the cylindrical payload compartment of the carrier vehicle. The reaction pneumatically blows the chaff out of wrapped bundles leaving the wrapper bonded to the structural framework and disseminating the chaff dipoles in a cloud of hot gas and air mixed with the generated gases by turbulent mixing in the wind shear occurring in the wake of the delivery device. The structural delivery device of the present invention is designed to survive the dispensing and dissemination processes without loss of structural integrity so that no harmful debris is ejected into the chaff cloud. The gases generated pneumatically disseminate and disburse the chaff dipoles and contain no gas species that would be combustible in air, such as carbon monoxide or hydrogen, thereby precluding ignition of the aluminized coating of the dipole chaff members in a secondary combustion process. The gas temperature is also controlled by endothermic decomposition of companion salts to avoid ignition of the aluminized chaff coating as it is mixed with air during the dissemination process.

Those having skill in the art to which the present invention pertains, will as a result of the applicant's teaching herein, perceive various modifications and additions which may be made to the invention. By way of example, alternative oxidizers and endothermic salts may be substituted for those specifically disclosed herein to achieve the objectives of complete oxidation of the reactants and endothermic cooling of the gas mixture. Furthermore, it will now become apparent that various changes and additions may be made to the specific materials and shapes in the structure of the present invention. By way of example, the length of the dispensing structure may be readily shortened or lengthened to alter the number of payload-containing sections. In addition, the separation between such sections may be altered by simply modifying the spacing between the disks shown herein. Accordingly, all such modifications and additions are deemed to be within the scope of the invention which is to be limited only by the claims appended hereto.

I claim:

1. A chaff dispenser comprising:

a structural delivery device, a payload compartment in the structural delivery device, a selectively activated source of fluid pressure in the payload compartment;

a wrapper in the payload compartment;

a bundle of chaff disposed in the wrapper in at least partially enveloping relation with said source, said wrapper-enclosed bundle being constructed to channel said fluid pressure from said source through said bundle and to provide for the emission of said chaff from said wrapper when the source is activated to provide the pressure;

said source being activated after the ejection of the payload compartment from the structural delivery device to produce the fluid pressure;

the wrapper being slit to facilitate the emission of the chaff from the wrapper; and means for preventing the wrapper from being emitted with the chaff during the emission of the chaff from the wrapper by the fluid pressure from the source.

2. The chaff dispenser recited in claim 1 wherein said chaff bundle is substantially toroidal in shape, with an axially oriented passage for receiving fluid pressure from the source and wherein said source of fluid pressure comprises tubular means which is positioned in said passage in substantially coaxial relation with said passage.

3. The chaff dispenser recited in claim 2 wherein said tubular means contains a combustible gas-generating material for producing the fluid pressure upon ignition.

4. The chaff dispenser recited in claim 3 wherein fluids are generated upon the ignition of the combustible materials and wherein a hydrate is disposed in the axially oriented passage to receive the fluids generated upon the ignition of the combustible material to cool such fluids.

5. A chaff dispenser comprising:

a wrapper, a bundle of chaff enclosed within the wrapper;

said chaff bundle being substantially toroidal in shape and having an axially oriented passage, tubular means positioned in said passage in substantially coaxial relation therewith;

said tubular means containing an ignitable fluid-generating material;

said ignitable fluid-generating material including a combustible material and an oxidizer, the combustible material and the oxidizer having characteristics to produce, upon combustion, fluids radially expansible at a temperature above the temperature for oxidizing the chaff in the bundle; and means in said tubular means for cooling the temperature of the expansible fluids produced by the combustion to provide a temperature of the expansible fluids at the chaff bundle lower than the temperature for oxidizing the chaff in the bundle, the expansible fluids being operative to expel the chaff radially from the wrapper; and means for preventing the wrapper from being expelled with the chaff during the expulsion of the chaff from the wrapper.

6. A chaff dispenser comprising:

a selectively activated source of fluids under pressure;

a wrapper, a bundle of chaff enclosed within the wrapper and disposed in at least partially enveloping juxtaposed relation with said source, said wrapper having openings for channeling said fluids under pressure through said bundle to obtain an expulsion of said chaff out of said wrapper;

said chaff bundle having an axially oriented passage and said source of fluid under pressure comprising a tubular member which is positioned in said passage in substantially coaxial relation therewith;

said tubular member comprising two concentric burstable tubes, said source including a combustible material which is disposed in the inner tube and which combusts to generate fluids and said source also including a hydrate which is disposed in the outer tube for cooling said generated fluids and for generating additional cooled fluids, and means for preventing the wrapper from being expelled with the chaff during the expulsion of the chaff from the wrapper.

7. A method of dispensing chaff comprising a plurality of dipole elements disposed in a bundle, comprising the steps of:

providing a source of fluids under pressure, the source including chemicals for reacting upon the activation of the source to produce the fluid pressure;

disposing said bundle within a wrapper;

positioning said bundle of dipole elements in at least partially enveloping relation with said source;

activating said source to obtain the chemical reaction for producing the fluids under pressure to blow said dipole elements radially out of said wrapper;

maintaining the temperature of the fluids under pressure on the bundle of dipole elements after the chemical reaction at a temperature below the temperature for oxidizing the dipole elements, and preventing the wrapper from being expelled with the dipole elements during the expulsion of the dipole elements from the wrapper.

8. The method recited in claim 7 further comprising the step of cutting said wrapper prior to activating said source for blowing said bundle of dipole elements out of said wrapper.

9. The method recited in claim 7 further comprising the steps of slitting the wrapper, disposing the source, the slit wrapper and the bundle of dipole elements in a payload compartment, ejecting the bundle of dipole elements from the payload compartment, and retaining the wrapper with the payload compartment.

10. The method recited in claim 7 wherein the step providing the source of fluids under pressure includes the steps of:

mixing a combustible material and an oxidizer;

placing said mixture in a burstable member for generating fluids for bursting the member in accordance with a combustion of the combustible material and the oxidizer; and providing an endothermic material to cool the combusted fluids to a temperature below the temperature for oxidizing the dipole elements.

11. The method recited in claim 10 including the step of separating the endothermic compound from said combustible material and said oxidizer for sequential ignition of said combustible material, oxidizing of the combustible material to produce resultant fluids providing the fluid pressure and endothermical cooling of the resultant fluids by the endothermic compound.

12. A dispenser for a payload, comprising:

a plurality of axially aligned, spaced apart disks disposed in a generally cylindrical array;

a plurality of elongated columns, each such column operatively coupled to the disks and extending the length of said array and having a plurality of grooves for attachment to said disks for structural support thereof;

each pair of adjacent disks forming the axial walls of a payload section receiving a payload to be dispensed therefrom;

each said disk having an aperture, the apertures of the respective disks being substantially aligned with one another to form a continuous passageway extending the length of said array; and a selectively activated source of fluids, the source being positioned in said passageway for emitting said payload out of said payload sections.

13. The dispenser recited in claim 12 further comprising a pair of base plates at the respective axial ends of said array; and means for securing the respective ends of said elongated columns to said base plates.

14. The dispenser recited in claim 12 wherein the payload sections include chaff particles and the source of fluids includes chemical components combustible to generate the fluids.

15. The dispenser recited in claim 14 wherein the chaff particles are formed from insulating material coated with aluminum and wherein the fluids generated by the combustion of the chemical components are chemically inert with respect to aluminum.

16. The dispenser recited in claim 15 wherein the source also includes means for cooling the fluids generated by the combustion of the chemical components below the temperature at which the aluminum oxidizes.

17. The dispenser recited in claim 12 wherein said source of fluids comprises a tubular gas generator and the payload comprises chaff particles and wherein the dispenser further comprises a delivery vehicle for transporting said payload to a desired location.

18. In combination, a burstable, membrane-enclosed chamber containing a first burstable tube and a second burstable tube enclosing the first tube; and a mixture of a combustible material and an oxidizer within said first burstable tube for generating expansible fluids upon the combustion of the mixture and for bursting the first burstable tube upon such combustion; and an endothermic material within said second burstable tube for cooling the expansible fluids;

chaff particles enclosing said second burstable tube for dissemination upon the combustion of the mixture within the first burstable tube and the bursting of the first and second burstable tubes;

the chaff particles being disposed in a bundle for expulsion from the bundle upon the combustion of the mixture;

a wrapper holding the bundle of chaff particles; and means for preventing the wrapper from being expelled with the chaff particles during the expulsion of the chaff particles from the wrapper.

19. A combination as set forth in claim 18 wherein said combustible material comprises nitrocellulose, said oxidizer comprises ammonium nitrate and said endothermic material comprises a compound selected from the group consisting of borax and boric acid.

20. In combination, a burstable membrane-enclosed chamber defined by a first tube and a second tube enclosing the first tube;

a pyrotechnic mixture as a heat source within the first tube;

a hydrated salt as a coolant and water source within the second tube;

the first tube being constructed to burst upon the generation of fluids at elevated temperatures from the combustion of the pyrotechnic mixture and the second tube being constructed to burst upon the passage of the combusted fluids into the second tube;

chaff disposed in the path of the fluids after the second tube has burst;

a wrapper holding the chaff;

means for providing for the expulsion of the chaff from the wrapper upon the generation of the fluids; and means for preventing the wrapper from being expelled with the chaff during the expulsion of the chaff from the wrapper.

21. A method of dispensing chaff, comprising the steps of:

a) providing a combustible material;

b) providing an oxidizer for oxidizing said material to produce resultant fluids;

c) providing an endothermic compound for cooling the resultant fluids;

d) arranging said combustible material, said oxidizer and said endothermic compound for a combustion of the combustible material by the oxidizer to produce combusted fluids and a subsequent cooling of the fluids by the endothermic compound;

e) introducing the cooled combusted fluids to chaff to disseminate the chaff without oxidizing the chaff, f) disposing the chaff within a wrapper having properties of providing for the dissemination of the chaff from the wrapper; and g) preventing the wrapper from being expelled with the chaff during the dissemination of the chaff from the wrapper.

22. A chaff dispenser comprising:

a selectively activated source of pressurized fluid;

a plurality of compartments disposed in communication with said source for holding the chaff;

at least two of said compartments respectively having disposed therein chaff having different characteristics;

dye chemicals of respectively different colors associated with individual ones of said two compartments for visually distinguishing the dispensed chaff from such individual ones of the compartments; and means for activating said source for dispensing said chaff and said dye chemicals from said compartments while preventing chemical destruction of said chaff and said dye chemicals.

23. In combination, first means defining at least one bundle having a central opening, a plurality of chaff particles disposed in the bundle, each of the chaff particles having an electrically conductive surface to define a dipole, wrapper means for retaining the chaff particles in the bundle, second means including a combustible material disposed in the central opening in the bundle and constructed to provide a combustion of the combustible material and a generation of expansible fluids as a result of the combustion and including an endothermic material disposed relative to the expansible fluids for expelling the chaff particles radially from the bundle at a temperature inhibiting the oxidation of the electrically conductive surfaces of the chaff particles, the wrapper means slit to provide for the expulsion of the chaff particles from the bundle upon the generation of the expansible fluids, and third means for preventing the wrapper means from being expelled with the chaff particles during the expulsion of the chaff particles from the wrapper means.

24. In a combination as set forth in claim 23, the wrapper being slit at positions adjacent the central opening in the bundle.

25. In a combination as set forth in claim 24, means disposed in the bundle and provided with properties for imparting an individual color to the space occupied by the chaff particles upon the expulsion of the chaff particles from the bundle.

26. In a combination as set forth in claim 24, the fluids being expansible radially into the bundle, the second means being constructed to provide a sequence of chemical reactions for initially combusting the combustible material to generate the fluids expansible radially into the bundle to expel the chaff particles radially from the bundle and for subsequently providing a reaction of the endothermic material to limit the temperature of the expansible fluids to a temperature below the temperature for oxidizing the electrically conductive surfaces of the chaff particles.

27. In combination, first means defining a bundle, a plurality of chaff particles disposed in the bundle and constructed to define electrical dipoles and having electrically conductive external surfaces, the bundle having a central opening, second means disposed in the central opening of the bundle for initially reacting chemically on an exothermic basis to generate fluids expansible radially into the bundle from the central opening for expelling the chaff particles radially from the bundle, third means disposed in the central opening of the bundle for subsequently providing an endothermic reaction in response to the heat from the fluids to limit the fluids to a temperature below the temperature for oxidizing the electrically conductive external surfaces of the chaff particles, a wrapper, the chaff particles in the bundle being retained in the wrapper, and fourth means for preventing the wrapper from being expelled with the chaff particles when the chaff particles are expelled radially from the bundle.

28. In a combination as set forth in claim 27, a first tube disposed in the central opening in the bundle for holding the second means and constructed to provide for the radial expansion of the fluids from the first tube, and a second tube disposed in the central opening in the bundle in enveloping relationship to the first tube for holding the third means and responsive to the heat from the fluids for producing an endothermic reaction to limit the temperature of the fluids expanding radially into the bundle from the second tube to a temperature below the temperature for oxidizing the electrically conductive surfaces of the chaff particles.

29. In a combination as set forth in claim 28, fifth means disposed in the bundle for expulsion radially from the bundle with the chaff particles to provide a distinctive color to the space occupied by the chaff particles after such expulsion.

30. In a combination as set forth in claim 27, fifth means disposed in the bundle for expulsion radially from the bundle with the chaff particles for providing a distinctive color to the space occupied by the chaff particles after such expulsion without raising the temperature of the chaff particles to a temperature above the temperature for oxidizing the electrically conductive surfaces of the chaff particles, and the wrapper being slit before the chemical reaction of the second means to facilitate the expulsion of the chaff particles from the bundle.

31. In combination, first means defining at least one bundle having a central opening, a wrapper disposed in the bundle, a plurality of chaff particles disposed in the wrapper, each of the chaff particles having an electrically conductive surface to define a dipole, the wrapper being constructed to prevent the expulsion of chaff particles from the wrapper, second means disposed in the opening in the bundle and including materials for reacting chemically to generate fluids expansible radially to expel the chaff particles radially from the bundle, the wrapper being slit prior to the generation of the expansible fluids to facilitate the expulsion of the chaff particles from the bundle, and third means for preventing the wrapper from being expelled during the expulsion of the chaff particles from the bundle.

32. In a combination as set forth in claim 31, the second means including a tube and chemicals disposed within the tube to provide a chemical reaction for generating the expansible fluids.

33. In a combination as set forth in claim 32, means notched to provided for the slitting of the wrapper axially prior to the generation of the expansible fluid to facilitate the expulsion of the chaff particles from the bundle.

34. In a combination as set forth in claim 32, fourth means disposed in the bundle for expulsion from the bundle with the chaff particles and having properties for providing the space encompassing the expelled chaff particles with a distinctive color.

35. In combination, first means defining at least one bundle having a central opening, a wrapper disposed in the bundle, a plurality of chaff particles disposed in the wrapper, each of the chaff particles having an electrically conductive surface to define a dipole, second means disposed relative to the opening in the bundle for initially reacting chemically to generate fluids expansible radially into the bundle to expel the chaff particles radially from the bundle and for subsequently maintaining the temperatures of the expansible fluids in the bundle, before the expansion of the expansible fluids into the bundle, at a temperature below the temperature at which the conductive surfaces of the chaff particles oxidize, the wrapper being slit to facilitate the expulsion of the chaff particles from the bundle upon the generation of the expansible fluids, third means associated with the second means for retaining the second means in the central opening in the bundle and for providing for the expansion of the fluids from the second means into the bundle upon the generation of the fluids, fourth means for preventing the wrapper from being expelled with the chaff particles during the expulsion of the chaff particles radially from the bundle.

36. In a combination as set forth in claim 35, the third means including a tube disposed in the central opening in the bundle and having properties of bursting upon the generation of the expansible fluids to pass the expansible fluids radially into the bundle, and the second means including a combustible material and an oxidizer disposed in the tube for combusting the combustible material to generate the fluids.

37. In a combination as set forth in claim 35, the third means including a first tube disposed in the central opening in the bundle and constructed to pass the expansible fluids radially and further including a second tube disposed in the central opening in the bundle in enveloping relationship to the first tube and constructed to pass the expansible gases radially into the bundle, and the second means including a combustible material and an oxidizer disposed in the first tube for oxidizing the combustible material in an exothermic reaction to generate the fluids expansible into the second tube and further including a material disposed in the second tube and responsive to the heat from the expansible fluids in an endothermic reaction to limit the temperature of the expansible fluids in the bundle to a temperature below the temperature at which the electrically conductive surfaces of the chaff particles oxidize.

38. In a combination as set forth in claim 37, fifth means disposed in the bundle for expulsion with the chaff particles for imparting an individual color to the chaff particles after the expulsion of the chaff particles from the bundle without increasing the temperature on the electrically conductive surfaces of the chaff particles to the temperature at which the electrically conductive surfaces of the chaff particles oxidize.

39. In a combination as set forth in claim 35, means disposed in the bundle for expulsion with the chaff particles and responsive to the heat from the expansible fluids in the bundle for generating an individual color in the space occupied by the expelled chaff particles.

40. In combination, first means defining at least one bundle having a central opening, a plurality of chaff particles disposed in the bundle, each of the chaff particles having an electrically conductive surface to define a dipole, first chemical means disposed in the central opening in the bundle for initially reacting chemically to generate a controlled exothermic reaction, at a temperature above the temperature for oxidizing the conductive surfaces of the chaff particles, to produce fluids expansible into the bundle to expel the chaff particles from the bundle, second chemical means disposed in the central opening in the bundle for generating a controlled endothermic reaction to provide in the expansible fluids a temperature below the temperature for oxidizing the electrically conductive surfaces of the chaff particles, third chemical means disposed in the bundle for expulsion with the chaff particles and responsive to the heat from the expansible gases in the bundle for generating an individual color in the space occupied by the chaff particles outside of the bundle without increasing the temperature on the electrically conductive surfaces of the chaff particles to a temperature at which the electrically conductive surfaces of the chaff particles become oxidized, the first means including a wrapper holding the chaff particles, and means for preventing the wrapper from being expelled with the chaff particles during the expulsion of the chaff particles from the bundle.

41. In a combination as recited in claim 40, the first chemical means including a combustible material and an oxidizer chemically reactive to generate fluids expansible at an elevated temperature toward the bundle and the second chemical means including additional chemicals responsive to the heat from the expansible fluids for reacting on an endothermic basis to limit the temperature of the fluids expansible into the bundle to a temperature below the oxidizing temperature of the conductive surfaces of the electrically chaff particles.

42. In a combination as recited in claim 41, the additional chemicals included in the second chemical means including a hydrate responsive to the heat from the expansible fluids for generating steam on an endothermic basis; and the combustible material and the oxidizer providing a combustion of the combustible material and the generation of the expansible fluids before the expansion of the fluids into the bundle to expel the chaff particles from the bundle.

43. In a combination as set forth in claim 42, the combustible material constituting a nitrocellulose and the oxidizer constituting a nitrate.

44. In combination, means defining a dispenser structure, means including a plurality of discs and at least one column in the dispenser structure for dividing the dispenser structure into a plurality of sections, a plurality of wrapper means each disposed in the dispenser structure and configured in accordance with the configuration of an individual one of the sections, a projectile including the dispenser structure and means covering the dispenser structure means, the covering means being separable from the dispenser structure in an axial direction, a plurality of particles of chaff disposed in each individual one of the sections and confined by the wrapper means in such individual one of the sections for radial movement from such individual one of the sections, means disposed in the dispenser structure radially interior to the chaff particles and expansible radially for expelling the chaff particles from the sections, the wrapper means being slit to facilitate the expulsion of the chaff particles from the sections, and means for preventing the wrapper means from being expelled during the expulsion of the chaff particles from the sections.

45. In a combination as set forth in claim 44 wherein the expansible means includes chemical means reactive to generate fluids expansible into the sections holding the chaff particles for expelling the chaff particles from the sections.

46. In a combination as set forth in claim 44, the expansible means including a inner tube and a combustible material and an oxidizer disposed in the inner tube to provide a chemical reaction on an exothermic basis for the production at an elevated temperature of the fluids expansible radially from the inner tube, and the expansible means further including an outer tube enveloping the inner tube and chemical means disposed in the outer tube and responsive to the elevated temperature from the expansible fluids for reacting chemically on an endothermic basis to limit the expansible fluids to a temperature below the oxidizing temperature of the chaff particles as the fluids expand into the sections holding the chaff particles.

47. In a combination as set forth in claim 46, means disposed in the sections and responsive to the heat from the fluids expansible into the sections for imparting an individual color to the space occupied by the chaff particles after the expulsion of the chaff particles from the sections.

48. In a combination as set forth in claim 44, the retaining means including a plurality of columns disposed in the dispenser structure for holding the wrapper means and the wrapper means being shaped to conform to the dispenser structure means for retention by the dispenser structure.

49. In combination, a plurality of sectioning means disposed in a spaced relationship in a first direction, a plurality of supporting means extending in the first direction and spaced from one another in a second direction transverse to the first direction and operatively coupled to the sectioning means to define with the sectioning means a plurality of compartments spaced from one another in the first direction, a plurality of wrapper means each disposed in an individual one of the compartments and supported by one of the supporting means, pluralities of chaff particles, each of the pluralities of chaff particles being disposed in an individual one of the wrapper means, first means disposed in the compartments for producing fluids under pressure and for providing for the introduction of such fluids under pressure into the compartments to provide for the expulsion of the chaff particles from the wrapper means the wrapper means being slit before the production of the fluids under pressure to facilitate the expulsion of the chaff particles in the pluralities from the wrapper means, and second means for preventing each of the wrapper means from being expelled from each of the compartments during the expulsion of the chaff particles from said wrapper means.

50. In a combination as set forth in claim 49, the first means including chemical components combustible to generate the fluids under pressure.

51. In a combination as set forth in claim 50, the chaff particles having a conductive coating with properties of oxidizing at a particular temperature above ambient, the chemical components having properties of combusting at a temperature above the particular temperature, the first means including additional chemical components responsive to the heat generated by the combustion of the first chemical components for reducing the temperature of the fluids under pressure to a temperature below the particular temperature and for generating additional fluids at such reduced temperatures.

52. In a combination as set forth in claim 49, the plurality of wrapper means having central apertures and the first means being disposed within the apertures.

53. In a combination as set forth in claim 52, each of the wrapper means being slit at the central aperture in the wrapper means.

54. In a combination as set forth in claim 53, the first means including chemical components combustible to generate the fluids under pressure, the chaff particles having a conductive coating with properties of oxidizing at a particular temperature above ambient, the chemical components having properties of combusting at a temperature above the particular temperature, the first means including additional chemical components responsive to the heat generated by the combustion of the first chemical components for reducing the temperature of the fluids under pressure to a temperature below the particular temperature and for generating additional fluids at such reduced temperatures.

* * * * *